United States Patent [19]

Starp

[11] 4,216,626

[45] Aug. 12, 1980

[54] MACHINE FOR GRINDING AND POLISHING WORKPIECES

[75] Inventor: Franz Starp, Wildbad, Fed. Rep. of Germany

[73] Assignee: Prontor-Werk Alfred Gauthier G.m.b.H., Wildbad, Fed. Rep. of Germany

[21] Appl. No.: 905,493

[22] Filed: May 12, 1978

[30] Foreign Application Priority Data

May 13, 1977 [DE] Fed. Rep. of Germany ..... 2721553

[51] Int. Cl.[2] ..... B24B 13/02

[52] U.S. Cl. ..... 51/58; 51/124 L

[58] Field of Search ..... 51/58, 124 L

[56] References Cited

U.S. PATENT DOCUMENTS

| | | | |
|---|---|---|---|
| 1,199,519 | 9/1916 | Arnold | 51/58 |
| 2,435,126 | 1/1948 | Burch | 51/58 |
| 3,782,042 | 1/1974 | Strasbaugh | 51/58 |

*Primary Examiner*—Harold D. Whitehead

[57] ABSTRACT

Machine for grinding and polishing workpieces having a spherical surface, such as spectacle glasses, optical lenses, and the like, including a workpiece support disposed for rotation about a generally vertical axis for mounting the workpiece for exposure during the machining operation to the action of a work tool operatively applied under pressure against the workpiece for carrying out such action, the workpiece support having a spherical workpiece receiving surface provided with a predetermined radius of curvature generally corresponding to that of the spherical surface of the workpiece to be operatively mounted thereon and situated such that the center of the radius of curvature coincides with the rotation axis of the workpiece support, a work tool holder such as a pressure spindle sleeve for operatively holding the work tool for carrying out the grinding and polishing action and for maintaining the work tool against the workpiece under the applied pressure, a rocker connected to the work tool holder to form a unit therewith and mounted for reciprocating movement about a pivot axis arranged generally normal to the rotation axis of the workpiece support, and a reciprocating drive such as a crank drive for effecting reciprocating movement of the rocker and work tool holder, in which the reciprocating drive is provided with reciprocating means having an invariable or constant operative amplitude of reciprocating movement such as crank arm means having an invariable operative crank radius and corresponding amplitude of crank reciprocating movement, and in which an intermediate selectively variable drive transmission means is further provided.

20 Claims, 3 Drawing Figures

Fig. 3

Figure 1:
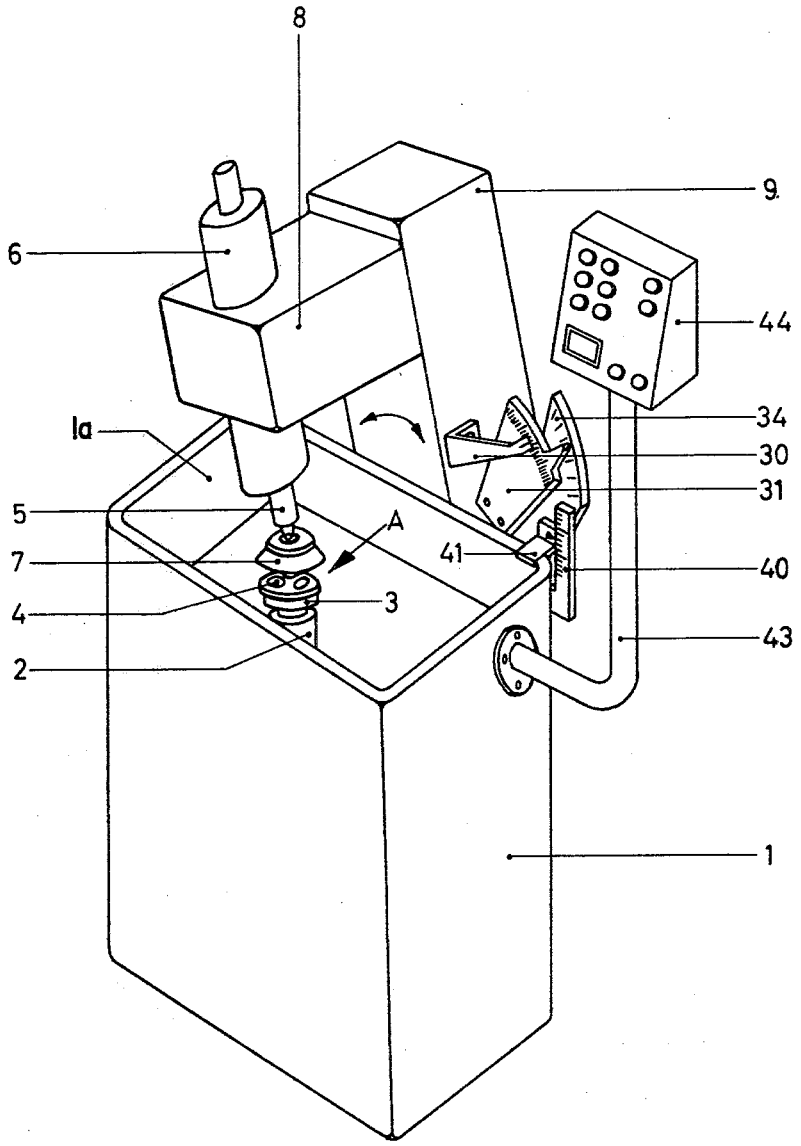

RADII RANGE
OSCILL. POSITION
OSCILL. AMPLIT.
44
45a
45b
46a
46b
47a
47b
12
9
B'
B
6
C'
C
5
7
4
3
M
r
2
10
28
27
26
28a
9a
24
23
31a
30
34
34a
32
31
40
41
40a
1
43
13
14
15
16
11
17
12
a
22
18
21
20
3
38
37
36
19

17
20
18
22
19

MACHINE FOR GRINDING AND POLISHING WORKPIECES

The present invention relates to a machine for grinding and polishing workpieces having a spherical surface, such as spectacle glasses, optical lenses or the like, the workpiece or workpieces being mounted on a rotating support for exposure during the machining process to the action of a tool applied against the workpiece or workpieces under pressure, which tool is held by a pressure spindle sleeve which in turn is fastened to a rocker adapted for reciprocating movement by means of a crank drive, utilizing an intermediate transmission drive means in a selectively adjustable manner and mounted on a rocker pivot axle arranged normal to the axis of rotation of the workpiece support.

German DOS 2,252,502 discloses a machine for grinding and polishing lenses using a rocker which is mounted on an axle and is movable back and forth by means of a motorized crank drive. For the purpose of adjusting the amplitude of the oscillatory movement of this rocker, the motorized crank drive as a whole is guided linearly movably on the machine frame and is variable in its relative position by means of a hand crank as well as positioning spindle non-rotationally connected therewith. Depending on the direction of rotation of the crank, the crank pin of the crank drive, engaging in the slide-block of a lever arm, undergoes a displacement such that the distance of the crank pin from the pivot axle of the rocker is correspondingly increased or reduced.

A disadvantage of this known crank drive arrangement lies in the fact that, due to the direct action of the crank pin on the slide-block arm of the rocker, distortions of the sine configuration having an unfavorable effect on the movement conditions of the rocker, i.e. different angular velocities, occur in the reciprocating movement of the rocker. Such disadvantageous effects on the performance are the more pronounced, the closer the crank pin is brought to the pivot axle. For this reason alone, machines which are equipped with a rocker drive of the above described type are clearly unsuitable for the machining of workpieces or lenses having a strong or more pronounced radius of curvature, in particular those which, as is known, require an adjustment of the rocker in the vicinity of the set value zero or zero amplitude of rocker oscillation.

It is among the objects and advantages of the present invention to avoid the above discussed disadvantages of such known type rocker drive, and to provide an improved rocker drive, developed and perfected in such a way that it is able, as in the form of a relatively simple construction, to fulfill the requirements for achieving substantially more exact work results in connection with the grinding and polishing of workpieces, e.g. spectacle lenses, and furthermore is distinguished by a mode of operation easily adaptable to the conditions of use.

It is among the further objects and advantages of the invention to provide the corresponding machine equipped with such improved rocker drive in form and manner that even operators who have had little or no experience with this kind of machine will be able to carry out therewith, more or less automatically, exactly reproducible adjustment processes exclusively in accordance with given values, for accomplishing the desired grinding and polishing of workpieces, such as spectacle or eyeglass lenses or the like, with minimum chance of error.

Figures 2, 3:
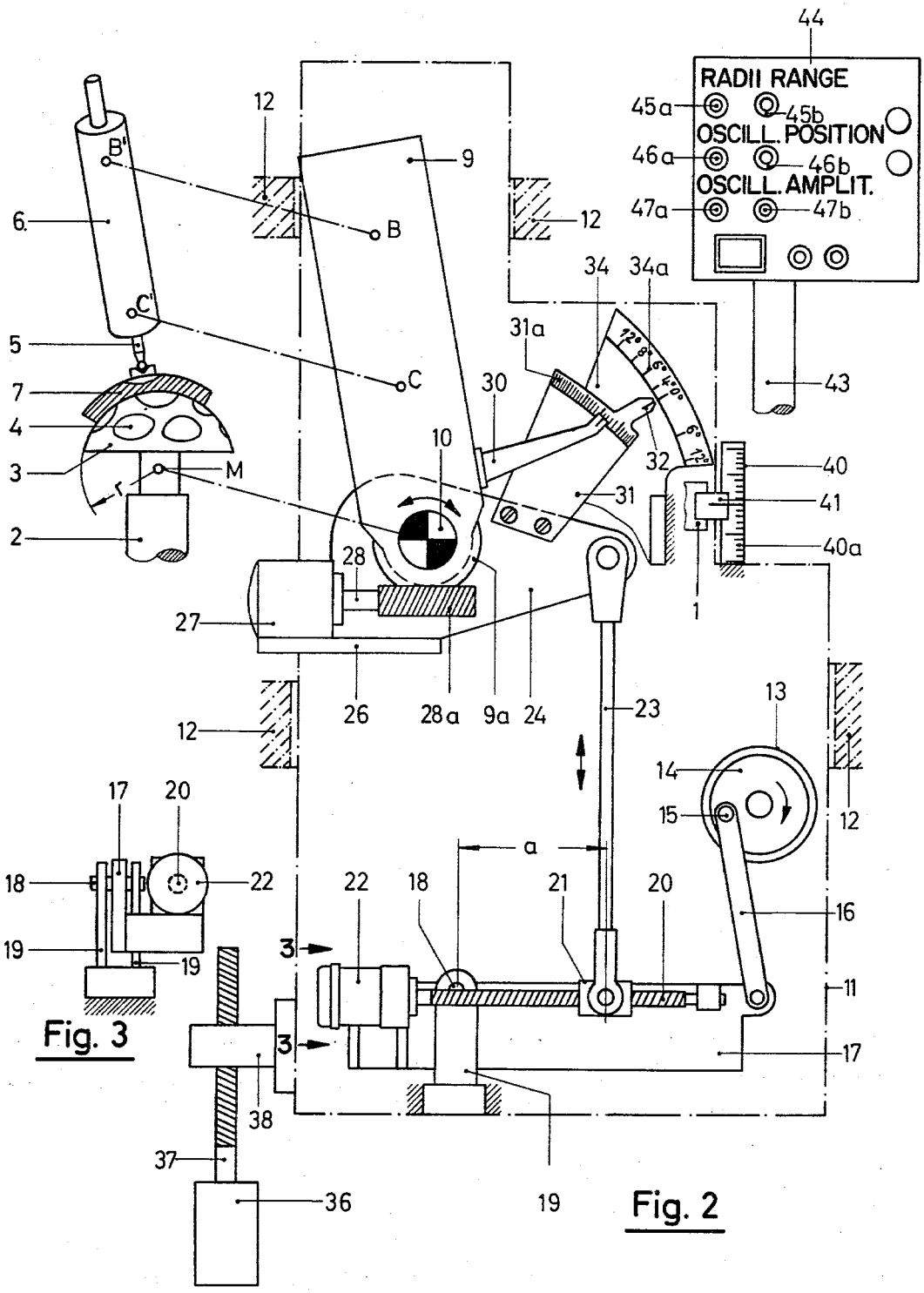

Other and further objects and advantages of the present invention will become apparent from a study of the within specification and accompanying drawings, in which:

FIG. 1 is an overall schematic perspective view of an embodiment of the basic machine for the machining of workpieces having a spherical surface usable according to the present invention;

FIG. 2 is a schematic view of the embodiment of FIG. 1 which shows in detail the rocker drive of the machine, indicating in phantom a carriage carrying the most important structural elements of the rocker drive system and guided for movement at the machine frame of the basic machine, and further indicating the workpiece and tool elements in laterally offset relation for clarity of illustration; and FIG. 3 is a schematic side view, in the direction of the arrows 3—3 indicated in FIG. 2, of the arrangement and suspension of the threaded spindle associated with the crank drive of the rocker system.

According to the present invention, a machine for grinding and polishing workpieces having a spherical surface, such as spectacle glasses, optical lenses, and the like is provided in which an intermediate drive variable with respect to its transmission ratio is arranged between the rocker, holding the work tool for action against the workpiece, and a preferably invariably constant operative amplitude reciprocating drive, e.g. crank drive. In this way, it has been possible to eliminate effectively all those unfavorable influences which heretofore resulted in distortions of the sine configuration during the oscillatory movement of the rocker and which had a disadvantageous effect on the desired performance.

More specifically, by way of the present invention, it is now possible to establish uniformity of the kinematic movement conditions of the rocker to such a degree that angular velocities are obtained without appreciable deviations during motion in both directions. Further, the rocker drive according to the present invention particularly permits the machining as well of workpieces whose machinable surfaces have a strong radius of curvature and consequently require rocker adjustments which may be close to the set value zero.

A preferred embodiment of the intermediate drive according to the invention is provided in the form of an adjustable transmission linkage, designed as a four-joint drive, selectively variable in its operative transmission geometric dimensions. With such an intermediate drive, especially favorable kinematic conditions can be obtained by making variable the interconnection between the rocker and reciprocating drive, e.g. the active lever arm of the input rocker in drive connection with the crank gear of the constant and invariable amplitude crank drive. An arrangement advantageously simple in construction and safe in operation can be obtained in this regard according to the invention by providing a threaded spindle with a follower nut for varying the operative linear dimension of the active lever arm of the input rocker.

To create the design conditions for favorable and simple adjusting of the central position of oscillation or operative midpoint of the rocker carrying the work tool holder, e.g. the pressure spindle sleeve, a coupling rod serves to bring the intermediate drive into driving connection with the tool-guiding rocker, and the rocker itself is made of two parts. One of the rocker parts is the part carrying the pressure spindle sleeve and the other is a part variable in its relative adjustment to the first part, e.g. by means of a positioning drive acting on the first rocker part, with the force from the crank drive acting via the intermediate drive on the second rocker part.

An adjustability means, simple in design and therefore having a favorable cost effect on the overall conception of the machine, is provided according to the invention by including a worm gear for varying the relative position, e.g. angular disposition about the rocker pivot axis, of the one part of the rocker carrying the pressure spindle sleeve with respect to the other part connected with the intermediate drive.

The set-up time for adaptation of the center of oscillation, i.e. of the height of the axis of the pivot of the rocker arm, to the center of curvature of the lens radius, i.e. as mounted on the rotatable workpiece support, can be greatly shortened according to the invention in a simple manner in that the constant and invariable oscillating amplitude crank drive, the selectively variable transmission ratio intermediate drive and the worm gear serving to adjust the two-part rocker are arranged on a common carriage, which is movably guided relative to the machine frame and variable in its relative position or height by means of a height-controlling spindle gear.

For the same purpose, namely to shorten the set-up time considerably, motor means may be provided for effecting the selective adjustment of the transmission ratio linkage of the intermediate drive, for operating the worm gear for selective angular adjustment of the two-part rocker, and for energizing the spindle gear for selective height adjustment of the common carriage.

Faulty operation in adjusting the various pertinent oscillation parameters of the machine can be particularly avoided in a simple manner according to the invention, such as by providing a pointer on one of the parts forming the rocker and a scale on the other rocker part adjustable relative thereto, to indicate visually the "oscillation position" or relative adjusted angular position about the rocker pivot axis of both parts, and in turn by providing a finger formed on this scale support on the other rocker part, cooperating with a fixed scale, e.g. on the machine frame, to indicate visually the "oscillation amplitude" or drive transmission ratio. Additionally, by arranging a linear scale secured on the machine frame to which a pointer movable with the common carriage is correlated to indicate visually the "radii range" or relative position of the axis of pivot of the rocker to the center of curvature of the lens radius as mounted on the rotatable workpiece support, like avoidance of faulty operation is attainable in this aspect as well.

In order that the indicia of these oscillation parameters to be adjusted can be plainly seen, according to a further advantageous feature of the invention, all such scales and conjoint indicator elements are brought together at one observable location readily visible from the normal location of the operator at the machine.

Referring to the drawings, and particularly to FIG. 1, a frame 1 of a machine for grinding and polishing spectacle or eye-glass lenses or the like having a spherical surface is shown, containing the usual rotating work spindle 2, carrying the support 3 which is adapted to receive for rotation therewith several workpieces 4 or blanks. The work spindle 2 is disposed in the normal manner in a vat 1*a* or recess formed on the machine frame and which suitably serves, as is known, to catch the polishing and/or cooling liquid supplied to work station A by means of a conventional system (not shown).

As can further be seen from FIG. 1, a tool holder, including for instance a tool spindle 5 and a cooperating pneumatic pressure cylinder 6, is provided. Specifically, tool spindle 5, designed as a pressure spindle sleeve, is disposed for axially aligned positioning with respect to the work spindle 2. Spindle 5 is guided for axial displacement in the cooperating pneumatic pressure cylinder 6 and acts under axial resilient or spring pressure in known manner via its lower end on the grinding or polishing tool 7, which in turn is applied onto the workpiece or workpieces to be machined. Cylinder 6, receiving the pressure spindle sleeve 5, is held by a support arm 8 secured on a rocker 9, and these parts form a common unit capable of simultaneous rocking oscillation.

As can be seen from FIG. 2, rocker 9 is fixedly mounted on a horizontal pivot axle 10 or bearing shaft. Accordingly, rocker 9 executes oscillating movements about the pivot axis of axle 10 during the operative process, so that spindle sleeve 5 and hence the tool 7 which is continuously applied under pressure against the workpieces 4 correspondingly undergo a continual variation of their relative position with respect to spindle 2.

For greater clarity, spindle sleeve 5 and spindle 2 are shown in FIG. 2 in laterally offset relation to the rocker 9, and the support arm 8 is merely indicated schemetically by two dash-dot lines with corresponding connecting points B, C, and B', C', respectively. Actually, points B' and C' of cylinder 6 lie in a plane which is normal to the plane of the paper regarding FIG. 2 and which intersects points B and C of rocker 9 as is more clearly shown in the orientation of these parts in FIG. 1.

The pivot axle 10 of rocker 9 is mounted rotatably, e.g. in journals (not shown), on a separate common carriage 11, indicated in phantom in FIG. 2, and such common carriage is selectively adjustable in height relative to the machine frame 1 by means of appropriate sliding or roller guides 12. This measure is necessary to be able to bring the height adjustment of axle 10 into desirable coincidence with the center M of the radius of curvature r of the respective spherical workpiece support 3 used in the operative process, such elements also being shown in laterally offset relation in FIG. 2 for greater clarity. Depending on the magnitude of the radius r, the axle 10 of rocker 9 must be moved up or down until the center M of the radius of curvature r of the workpiece support 3 and the ideal horizontal axis of the pivot pin or axle 10 have reached an exact uniform, e.g. vertical, level.

It will be seen that the axis of rotation of the rotating spindle 2 and support 3 in effect lies in one plane, e.g. a first vertical plane, and that the pivot axis of pivot axle 10 of rocker 9 correspondingly lies in another plane, e.g. a second vertical plane, and that the second plane is parallel to and disposed at a fixed distance from the first plane, in any position of movement of the carriage 11. Thus, while axle 10 of rocker 9 may be moved up or down relative to center M for the desired purposes, the pivot axis thereof will always remain in the second plane in constantly spaced relation to the axis of rotation of the spindle 2 and support 3.

In order to drive rocker 9, a reciprocating drive is used having a constant operative amplitude of reciprocating movement. This may be provided in the form of a crank drive known per se, for instance consisting of a motor 13, a crank sheave or member 14 mounted on the output shaft of the corresponding motor drive, and a connecting rod 16 pivotally hinged at one end to a stationary crank pin 15. Crank pin 15 is fixed on crank member 14 to provide an invariable or constant crank radius and corresponding amplitude of reciprocating movement. The other or outward free end of the connecting rod 16 pivotally engages via a floating pivot the freely movable end of a lever 17.

Lever 17 is rotationally mounted via a fixed pivot on the trunnion 18 of a bearing block 19 disposed on the common carriage 11. Lever 17 belongs to an intermediate drive or first positioning drive, whose other component parts include a threaded spindle 20 rotatably mounted on such lever 17, a traveling or follower spindle nut 21, a first geared motor 22 serving to drive spindle 20, and a coupling rod 23 articulatedly connected at the one or lower end thereof with the spindle nut 21 via a traveling pivot thereat. Coupling rod 23 articulatedly engages at the other or upper end thereof with a lever arm 24 rotatably mounted on axle 10. Coupling rod 23 thus provides for an invariable or constant linear distance between its articulation axis at spindle nut 21 and it articulation axis at lever arm 24.

Between this intermediate drive, formed advantageously in the manner of a four-joint drive, e.g. as a selectively adjustable transmission ratio second class lever linkage system, there is a form-locking connection with rocker 9, to which end a support plate 26 rigidly connected with lever arm 24 situated in carriage 11 has placed on it a further or second geared motor 27, the output shaft 28 of which, preferably designed as a worm shaft provided with worm **28*a*, is in operative engagement with a serration 9*a* correspondingly designed on rocker 9 and forming a worm wheel for coaction with worm 28*a***.

While by means of this resultant further or second intermediate positioning drive of worm gear **9*a*, 28*a* the basic adjustment of the rocker 9 can be selectively varied, i.e. the relative angular position of rocker 9 with respect to the work spindle 2 can be selectively varied, the above described intermediate drive or first positioning drive serves to fix selectively the lever ratios determining the amplitude of oscillation of rocker 9, or more specifically the active point of engagement of the coupling rod 23 on the threaded spindle 20 via traveling spindle nut 21. There is also a certain functional interdependence between the two positioning drives inasmuch as each variation of the lever ratio, i.e. selective reduction or increase of the lever portion or lever arm a, which is defined by the distance between the axis of trunnion 18 and the point at which spindle nut 21 is disposed along drive spindle 20, is accompanied by a variation—if even a slight one—of the previous center position of rocker 9, due to the constant dimension of the linkage of coupling rod 23 between spindle nut 21 and lever arm 24, into which the rocker 9 can be suitably returned by means of the motorized worm gear 9*a*, 28*a*. While such worm gear serves to rotate rocker part 9 and axle 10 relative to carriage 11 for this adjustment, rocker lever arm part 24 and motor 27 on plate 26 remain in position relative to carriage 11 during this time since these latter components are rotatably freely suspended on axle 10 under the control of coupling rod 23**.

The set position or "oscillation position" of rocker 9 relative to the actuating lever arm 24 obtainable with the worm gear **9*a*, 28*a* can be readily visually indicated by means of a pointer arm 30 fastened on the rocker. The pointer arm 30 is conveniently associated with a scale arc 31*a*, having appropriate reference markings, which in turn is provided on a plate 31 rigidly connected with the actuating lever 24. A finger 32 is formed on this plate 31, and due to the form-locking connection between lever 24 and rocker 9 by the worm gear 9*a*, 28*a*, such finger 32 always participates in the oscillatory movements of rocker 9. Thus, the "oscillation amplitude" of rocker 9 can also be suitably made visible to the operator on a scale 34*a*** *l associated with finger 32. Scale 34a* having indicia corresponding to pertinent angle divisions is applied on a plate 34 fastened on carriage 11.

With regard to the height adjustment of carriage 11, for this purpose, i.e. for moving the carriage up and down, a positioning spindle 37 drivable by means of a still further or third geared motor 36, e.g. mounted on machine frame, advantageously is provided. The vertical spindle 37 engages in a correspondingly threaded positioning block 38, which in turn is fastened to the carriage 11. To indicate the height position of carriage 11, a ruler 40 may be provided which is rigidly associated with the carriage 11 and on which a linear scale **40*a* is formed, whereby the corresponding axle 10—center of radius of curvature M "radii range" adjustment movement or the set poosition reached can likewise be suitably read with the aid of a cooperating line mark member 41 on the machine frame 1**.

As is evident in particular from FIG. 1, a control box 44 having a control panel, containing the most important buttons necessry to operate the machine with appropriately labelled designations, is conveniently arranged by means of a prop or leg 43 near the location of the above described observable scale arrangements. Thus, for the purpose of adjusting the so-called "Radii Range," i.e. for achieving coincidence of the axis of axle 10 and center M, two alternately operate switch buttons **45*a* and 45*b* are provided, by the actuation of which motor 36 is set in corresponding forward and reverse rotational motion. Depending on which of the buttons 45*a*, 45*b* is pressed, motor 36, and of course the spindle 37 driven by it, will execute rotational movements in one or the other appropriate rotational direction. Analogously, the additional buttons 46*a* and 46*b* which also are to be pushed, serve to adjust the optimum "Oscillation Position" of rocker 9, i.e. the angle of offset between parts 9 and 24 on axle 10. As one or the other button 46*a*, 46*b* is pressed, worm shaft 28, and in turn worm 28*a* will be driven by motor 27 in one or the other appropriate direction of rotation to accomplish the desired angular adjustment. The "Oscillation Amplitude" adjustment for varying the drive transmission ratio takes place likewise by actuation of one of the switch buttons 47*a*, 47*b*, whereby motor 22 is set in appropriate motion. While by actuation of button 47*a* the spindle 20** is driven in a direction resulting in a reduction of the lever arm *a*, on the other hand by actuation of the other button **47*b* the spindle 20 is driven in the opposite direction, whereby the lever arm a is increased with respect to the distance of the point of engagement of connecting rod 23 from the pivot point or trunnion 18**.

All switch buttons of the above described control parameters are suitable designed in the conventional manner so that the geared motor energized by the actuation of a corresponding button remains energized in the appropriate rotational direction until the finger pressure is removed from the button.

Since according to the embodiment shown in FIG. 2 and 3, the threaded spindle 20 passes by the bearing block 19 laterally, it is advantageously possible upon actuation of the respective button associated with the "Oscillation Amplitude" adjustment feature to reduce the active lever arm a at lever 17 to such an extent that at the end of the positioning movement for rocker 9 there results an amplitude of the value "zero". This can be achieved by bringing the spindle nut 21 up to and axially coincidental with the fixed pivot point or trunnion 18 of lever 18. The maximum amplitude of oscillation of rocker 9 occurs, on the other hand, when spindle nut 21 occupies a relative position to the fixed pivot point or trunnion 18 having the greatest lever distance a from pivot point 18 of lever 17.

It will be appreciated, therefore, that in accordance with the present invention a machine for grinding and polishing workpieces having a spherical surface, such as spectacle glasses or eyeglasses, optical lenses, and the like, of the foregoing type is advantageously provided in which the reciprocating drive for the rocker and work tool holder includes reciprocating means having an invariably constant operative amplitude of reciprocating movement and in which in conjunction therewith an intermediate selectively variable drive transmission means is provided with operatively interconnects the constant amplitude reciprocating means of the reciprocating drive with the rocker and which has a variable operative drive transmission ratio for selective adjustment of the amplitude of reciprocating movement of the rocker and work tool holder.

In this way, during rotation of the workpiece support and work tool action under rocker oscillation, distortions of the sine configuration having an unfavorable effect on the movement conditions of the rocker will be significantly avoided. In particular, such distortions at the correspondingly different angular velocities encountered will not occur even when the rocker oscillation amplitude is required to be adjusted in the vicinity of the set value zero or zero oscillation amplitude range as in the case of workpieces having a strong or pronounced radius of curvature, i.e. where the radius r is relatively short for example as compared with the operative maximum oscillation amplitude of the reciprocating means, or that of the invariably constant crank radius, as transmitted.

Preferably, the intermediate drive transmission means is provided in the form of an adjustable drive transmission linkage having an operative adjustment range selectively varying from a maximum amplitude of reciprocating movement as determined by the corresponding invariably constant operative amplitude of the reciprocating means of the reciprocating drive to an approximately zero amplitude of reciprocating movement. The drive transmission linkage may be suitably constructed as a simple, sturdy and precisely functioning four-joint linkage drive correspondingly variable in its operative transmission geometric dimensions, e.g. a linkage lever system.

More particularly, such lever system may contain an input rocker lever pivotally mounted at a first point thereon on a fixed pivot and pivotally connected at a second point thereon linearly spaced from the first point and from the fixed pivot to the reciprocating means or crank arm means for driven reciprocating movement in accordance with fixed characteristics of the crank drive, attachment means operatively disposed for selectively adjustable movement along a lever arm path having a range extending from the first point on the lever at the fixed pivot to a further point on the lever linearly spaced from the first point and remote from the fixed point, and a connecting rod operatively pivotally connected at a proximate pivotal point thereon to the attachment means and at a distal pivotal point thereon to the rocker.

Selective adjustment of the amplitude of reciprocating movement as imparted to the rocker at the distal pivotal point may thereby be advantageously carried out from a maximum amplitude determined by the corresponding amplitude of the reciprocating means or crank arm means, e.g. invariably constant crank radius of the crank drive, when the attachment means is moved to the further point, e.g. the second point in the case of a second class lever system, on the lever remote from the fixed pivot to an approximately zero amplitude when the attachment means is moved to the first point on the lever and the proximate pivotal point of the connecting rod and the fixed pivot are in approximate operative coincidence.

Generally, the four-joint drive may comprise a pivotally mounted input rocker lever in drive connection with the reciprocating means or crank arm means of the crank arm drive and having an active lever arm portion a, and output linkage varying means operatively connected between the input rocker lever and the rocker and adjustably disposable with respect to the active lever arm portion of the input rocker lever whereby to vary the magnitude of the corresponding active lever arm thereof and in turn the transmission ratio of the intermediate drive means. Suitably, such output linkage varying means may comprise attachment means, for instance including a threaded spindle rotatably disposed on the input rocker lever along the active lever arm portion thereof and a traveling follower nut operatively disposed on the threaded spindle for varying the magnitude of the active lever arm. Output linkage means in turn may be provided on the attachment means for operative connection to the rocker, for instance including a coupling rod or connecting rod pivotally connected to the follower nut for transmitting the force of the reciprocating drive or crank drive via the input rocker lever and threaded spindle to the rocker in dependence upon the position of the follower nut.

Selective variable intermediate positioning drive transmission means are also desirably contemplated in association with the rocker for operatively interconnecting the intermediate drive transmission means or linkage lever system with the rocker under selective compensating adjustment of the angular positional orientation of the mid-point of the amplitude of reciprocating movement, e.g. with respect to a reference plane intersecting the pivot axis of the rocker, in corresponding relation to the drive transmission ratio selected for the intermediate drive transmission means or linkage lever system. Thus, the rocker may be formed of a pair of separate rocker parts mounted for reciprocating movement together about the rocker pivot axis, including a first rocker part carrying the work tool holder or pressure spindle sleeve and a second rocker part variable in its relative adjustment position to the first rocker part and operatively connected to the output linkage means or coupling or connecting rod of the four-joint linkage drive at a point on such rod spaced from the pivotal connection thereof to the attachment means or follower nut, whereby the intermediate positioning drive transmission means may adjust the relative disposition between the two separate rocker parts. In particular, the intermediate positioning drive means may advantageously comprise a worm gear operatively interconnecting the two rocker parts for relative angular displacement therebetween about the axis of pivot of the rocker.

Preferably, an arrangement is contemplated wherein the rocker includes a first support part connected to the pressure spindle sleeve and a second offset arm part, i.e. offset relative to the first support part about the rocker axis of pivot, to which the distal pivotal point of the coupling or connecting rod of the four-joint drive linkage is pivotally connected, with said rocker parts being mounted for reciprocating movement together about the rocker axis of pivot and for relative rotational positioning movement with respect to each other about such axis of pivot. In this way, the selectively variable positioning means may selectively control the relative rotational positioning movement between the two rocker parts and thereby compensate for changes in the drive transmission ratio in dependence upon the position of the attachment means or follower nut along its lever movement path. By reason of the inclusion of a simple, sturdy and precisely functioning worm gear means at the operative interconnection of the two rocker parts on the common rocker shaft, the rocker support part may be conveniently rotationally moved relative to the rocker offset arm part, i.e. to change the angle of offset therebetween about the rocker axis of pivot.

The selectively adjustable carrier means and spindle gear operatively connected thereto for varying the vertical position thereof relative to the machine portion containing the workpiece support, advantageously permit displacement together of the two rocker parts, the reciprocating means or crank drive, the intermediate drive transmission means or linkage lever system and the selectively variable intermediate positioning means or worm gear means, in relation to the workpiece support to bring the work tool holder or pressure spindle sleeve into operative position for the work tool to be applied against the workpiece. Additionally, the presence of the appropriately located visual indicating means advantageously permit readily observable precise indication of the relative angular position about the pivot axis of the rocker as between the two rocker parts, the drive transmission ratio and corresponding amplitude of common reciprocating movement of the rocker parts in dependence upon the position of the attachment means or follower nut along the lever arm movement path thereof, and the relative position of displacement between the carrier means or carriage means and the workpiece support and in turn of the relative levels of the center of the radius of curvature of the workpiece support and the axis of pivot of the rocker.

Accordingly, by reason of the foregoing constructional features of the present invention, a simple, sturdy, safe and readily adaptable system is provided for repeatedly achieving exact and uniform work results even by operators having little or no experience with the type of machine in question, and permitting exactly reproducible selective adjustment of the appropriate parameters exclusively in accordance with appropriate given values, e.g. of "radii range," "oscillation position" and "oscillation amplitude," as noted above, regardless of the skill of the operator and more or less automatically.

It will be appreciated that the instant specification and drawings are set forth by way of illustration and not limitation, and that various modifications and changes may be made therein without departing from the spirit and scope of the present invention which is to be limited solely by the scope of the appended claims.

What is claimed is:

1. Machine for grinding and polishing workpieces having a spherical surface, such as spectacle glasses, lenses, and the like, including a workpiece support disposed for rotation about an axis for mounting the workpiece for exposure during the machining operation to the action of a work tool applied under pressure against the workpiece, a pressure spindle sleeve for holding the work tool for carrying out such action, a rocker connected to the pressure spindle sleeve and mounted for reciprocating movement about an axis of pivot arranged normal to the axis of rotation of the workpiece support, the rotation axis of the workpiece support lying in a first plane and the pivot axis of the rocker lying in a second plane parallel to and disposed at a fixed distance from the first plane, and a crank drive for effecting reciprocating movement of the rocker and in turn of the pressure spindle sleeve, in which the crank drive is provided with crank arm means having an invariable operative crank radius and in which an intermediate drive means is disposed operatively between the crank arm means of the crank drive and the rocker which has a variable operative drive transmission ratio for selective adjustment of the reciprocating movement of the rocker and pressure spindle sleeve.

2. Machine according to claim 1 wherein the intermediate drive means is provided as a four-joint linkage drive which is correspondingly variable in its operative transmission geometric dimensions.

3. Machine according to claim 2 wherein the four-joint drive includes a pivotally mounted input rocker lever in drive connection with the crank arm means of the crank drive and having an active lever arm portion, and output linkage varying means operatively connected between the input rocker lever and the rocker and adjustably disposable with respect to the active lever arm portion of the input rocker lever to vary the magnitude of the corresponding active lever arm thereof and in turn the transmission ratio of the intermediate drive means.

4. Machine according to claim 3 wherein the output linkage varying means include a threaded spindle rotatably disposed on the input rocker lever along the active lever arm portion thereof, and a traveling follower nut operatively disposed on the threaded spindle for varying the magnitude of such active lever arm and having output linkage means thereon for operative connection to the rocker.

5. Machine according to claim 4 wherein such output linkage means include a coupling rod pivotally connected to the follower nut for transmitting the force of the crank drive via the input rocker lever and threaded spindle to the rocker in dependence upon the position of the follower nut, and the rocker includes a first rocker part carrying the pressure spindle sleeve and a second rocker part variable in its relative adjustment position to the first rocker part and operatively connected to the coupling rod at a point on such rod spaced from the pivotal connection to the follower nut, and wherein intermediate positioning drive means are provided in association with the rocker for adjusting the relative dispositions between the first rocker part and the second rocker part.

6. Machine according to claim 5 wherein the intermediate positioning drive means include a worm gear operatively interconnecting the first rocker part and the second rocker part for relative angular displacement therebetween about the axis of pivot of the rocker.

7. Machine according to claim 6 wherein the first and second planes are vertical planes, common carriage means are provided which are positioned for guided vertical movement relative to the machine portion containing the workpiece support and on which the crank drive, the intermedite drive means, and the rocker parts including the intermediate positioning drive means are commonly carried, and a spindle gear operatively connected to the carriage means for varying selectively the vertical position thereof relative to the machine portion and in turn the level of the height of the rocker relative to the workpiece support and the vertical disposition of the pivot axis in the second plane relative to the rotation axis in the first plane.

8. Machine according to claim 7 wherein motor means are provided for correspondingly selectively rotating the threaded spindle of the intermediate drive, the worm gear of the intermediate positioning drive means and the spindle gear of the carriage means.

9. Machine according to claim 8 wherein a pointer is provided on one of the rocker parts and a scale support having a cooperating rocker scale in alignment with such pointer and displaceable with respect thereto is provided on the other of the rocker parts for indicating the selected angular relation between the two rocker parts, and a finger is formed on the scale support which cooperates with a stationary angular scale on the carriage means for indicating the selected oscillation amplitude of the rocker about the axis of pivot of the rocker, and wherein a linear scale moveable with the carriage means is associated with a stationary further painter secured to the machine portion containing the workpiece support for indicating the selective position of the carriage means relative to such machine portion.

10. Machine according to claim 9 wherein the rocker scale, stationary angular scale and stationary linear scale are arranged together at one observable location readily visible to the operator of the machine.

11. Machine for grinding and polishing workpieces having a spherical surface, such as spectacle glasses, lenses, and the like, which comprises a workpiece support disposed for rotation about an axis for mounting the workpiece for exposure during the machining operation to the action of a work tool operatively applied against the workpiece, a work tool holder for operatively holding the work tool for carrying out such action, a rocker connected to the work tool holder to form a unit therewith and mounted for reciprocating movement about an axis of pivot arranged normal to the axis of rotation of the workpiece support, the rotation axis of the workpiece support lying in a first plane and the pivot axis of the rocker lying in a second plane parallel to and disposed at a fixed distance from the first plane, a reciprocating drive for effecting reciprocating movement of the rocker and work tool holder and including a reciprocating means having a constant operative amplitude of reciprocating movement, and an intermediate selectively variable drive transmission means operatively interconnecting the constant amplitude reciprocating means of the reciprocating drive with the rocker and having a variable operative drive transmission ratio for selective adjustment of the amplitude of reciprocating movement of the rocker and work tool holder.

12. Machine according to claim 11 wherein the intermediate drive transmission means includes an adjustable drive transmission linkage having an operative adjustment range selectively varying from a maximum amplitude of reciprocating movement determined by the corresponding constant operative amplitude of the reciprocating means of the reciprocating drive to an approximately zero amplitude of reciprocating movement.

13. Machine according to claim 11 wherein selectively variable positioning drive transmission means are provided in association with the rocker for operatively interconnecting the intermediate drive transmission means with the rocker under selective compensating adjustment of the angular positional orientation of the mid-point of the amplitude of reciprocating movement of the rocker with respect to a reference plane intersecting the pivot axis of the rocker in relation to the drive transmission ratio selected for the intermediate drive transmission means.

14. Machine according to claim 11 wherein selectively adjustable carrier means are provided for displacing the rocker, reciprocating means and intermediate drive transmission means in relation to the workpiece support to bring the work tool holder into operative position for the work tool to be applied against the workpiece while correspondingly displacing the pivot axis of the rocker within the second plane.

15. Machine for grinding and polishing workpieces having a spherical surface, such as spectacle glasses, lenses, and the like, which comprises a work tool, a workpiece support disposed for rotation about an axis for mounting the workpiece for exposure during the machining operation to the action of the work tool operatively applied against the workpiece, said workpiece support having a spherical workpiece receiving surface provided with a predetermined radius of curvature corresponding to that of the spherical surface of the workpiece to be operatively mounted thereon and situated such that the center of such radius of curvature coincides with the rotation axis of the workpiece support, a work tool holder including a pressure spindle sleeve for operatively holding the work tool for carrying out such action and for maintaining the work tool against the workpiece under operatively applied pressure, a rocker connected to the work tool holder to form a unit with the pressure spindle sleeve and mounted for reciprocating movement about an axis of pivot arranged normal to the rotation axis, the rotation axis of the workpiece support lying in a first plane and the pivot axis of the rocker lying in a second plane parallel to and disposed at a fixed distance from the first plane, a reciprocating drive including a crank drive for effecting reciprocating movement of the rocker and pressure spindle sleeve and further including a reciprocating crank arms means having an invariably constant operative crank radius and corresponding amplitude of crank reciprocating movement, and an intermediate selectively variable drive transmission means operatively interconnecting the crank arm means and the rocker and having a variable operative drive transmission ratio for selective adjustment of the amplitude of the reciprocating movement of the rocker and pressure spindle sleeve, said intermediate drive transmission means being arranged for variation during reciprocating movement of the rocker by the crank drive and including an adjustable drive transmission linkage having an operative adjustment range selectively varying from a maximum amplitude of reciprocating movement determined by the corresponding constant operative amplitude of the crank radius to an approximately zero amplitude of reciprocating movement.

16. Machine according to claim 15 wherein the intermediate drive transmission linkage includes a lever operatively pivotally mounted at a first point thereon on a fixed pivot and operatively pivotally connected at a second point thereon linearly spaced from the first point and from the fixed pivot point to the crank arm means for reciprocating movement in accordance with the crank drive, attachment means operatively disposed for selectively adjustable movement along a lever arm path having a range extending from the first point on the lever at the fixed pivot to a further point on the lever linearly spaced from the first point and remote from the fixed pivot, and a connecting rod operatively pivotally connected at a proximate pivotal point thereon to the attachment means and at a distal pivotal point thereon to the rocker, for selectively adjusting the amplitude of reciprocating movement imparted to the rocker at the distal pivotal point from a maximum amplitude determined by the corresponding amplitude of the constant crank radius of the crank drive when the attachment means is moved to the further point on the lever remote from the fixed pivot to an approximately zero amplitude when the attachment means is moved to the first point on the lever and the proximate pivotal point of the connecting rod and the fixed pivot are in approximate operative coincidence.

17. Machine according to claim 16 wherein the rocker includes a first support part connected to the pressure spindle sleeve and a second offset arm part to which the distal pivotal point of the connecting rod is pivotally connected, said rocker parts being mounted for reciprocating movement together about the axis of pivot of the rocker and for relative rotational positioning movement with respect to each other about such axis of pivot, and selectively variable positioning means are provided in association with the rocker for selectively controlling the relative rotational positioning movement between said rocker parts and in turn for selective compensating adjustment of the angular positional orientation of the mid-point of the amplitude of reciprocating movement of the rocker support part, with respect to a reference plane intersecting the pivot axis of the rocker, in corresponding relation to the drive transmission ratio selected for the intermediate drive transmission means and in corresponding dependence upon the position of the attachment means along the movement path thereof.

18. Machine according to claim 17 wherein the selectively variable positioning means include worm gear means for selectively rotationally moving the rocker support part relative to the rocker offset arm part.

19. Machine according to claim 18 wherein selectively adjustable carrier means are provided for displacing together the rocker parts, crank drive, intermediate transmission linkage and worm gear means in relation to the workpiece support to bring the pressure spindle sleeve into operative position for the work tool to be applied against the workpiece.

20. Machine according to claim 19 wherein observable indicating means are provided for indicating the relative angular position about the pivot axis between the rocker support part and rocker offset arm part, the drive transmission ratio and corresponding amplitude of reciprocating movement of the rocker parts in dependence upon the position of the attachment means along the movement path thereof, and the relative position of displacement between the carrier means and the workpiece support and in turn of the relative levels of the center of the radius of curvature of the workpiece support and the axis of pivot of the rocker.

* * * * *